United States Patent [19]

Hagan et al.

[11] Patent Number: 4,520,941

[45] Date of Patent: Jun. 4, 1985

[54] WATER BOTTLE CRATE

[75] Inventors: John A. Hagan, Huntington Beach; James Lafferty, Fullerton, both of Calif.

[73] Assignee: Rehrig Pacific Company, Los Angeles, Calif.

[21] Appl. No.: 650,611

[22] Filed: Sep. 14, 1984

[51] Int. Cl.[3] ..... B65D 11/16

[52] U.S. Cl. ..... 220/72; 220/83; 220/94 R; 215/1 R

[58] Field of Search ..... 220/72, 83, 94 A, DIG. 15; 215/1 R, 12 R

[56] References Cited

U.S. PATENT DOCUMENTS

| | | | |
|---|---|---|---|
| 3,390,808 | 7/1968 | Rehrig et al. | 220/94 A |
| 3,628,684 | 12/1971 | Sere | 220/72 X |
| 3,802,595 | 4/1974 | Frahm et al. | 220/83 X |
| 4,143,784 | 3/1979 | Frahm et al. | 220/72 X |

*Primary Examiner*—Steven M. Pollard

*Attorney, Agent, or Firm*—Banner, Birch, McKie & Beckett

[57] ABSTRACT

A molded plastic crate for transporting and storing five-gallon water bottles having differing external configurations has the general form of an open-ended square box with reinforced internal corner struts nested within each of the four box corners adjacent a centrally apertured box bottom. Exterior midsection portions of the crate side walls adjacent the upstanding box corners are recessed to accommodate hand-truck pickup when the crate is lying on its side. A set of opposed aligned wide handle openings are provided in each pair of opposed crate side walls with one set being located at a different height above the box bottom than the other set. A separate retaining bar which projects into the crate interior near the perimeter of the box open end to restrain a bottle against unintentional slippage from the crate may be retained in place by a steel ring encircling the perimeter of the box open end.

7 Claims, 12 Drawing Figures

WATER BOTTLE CRATE

BACKGROUND OF THE INVENTION

This invention relates to the art of transporting and storing bottled water, being particularly useful in conjunction with large five-gallon water bottles as employed in the business of supplying drinking water contained in such large bottles.

More specifically the invention is directed to an improved water bottle crate particularly adapted to facilitate transporting and handling five-gallon water bottles, such bottles having a variety of external configurations and therefore requiring a bottle crate suitable for accommodating this variety of bottle configurations.

The generally recognized or standard five-gallon water bottle is characterized by having a generally cylindrical neck portion which flares outwardly into the main body of the bottle. The other end of the bottle is usually formed into a somewhat bulbous flat bottom.

These five-gallon water bottles generally have an external configuration for the main body of the bottle which provides one or more circumferential ribs on the bottle exterior. These circumferential ribs perform a strengthening function for the wall of the bottle body and also can be of assistance during handling of the filled five-gallon bottle. The commercially available designs of these five-gallon water bottles having one or more circumferential ribs have a variety of distinctively different external rib work configurations. The differing rib work makes design of a universally adapted water bottle crate to accommodate differently configured bottles a problem, a problem which must be taken into consideration in conjunction with crate construction.

SUMMARY OF THE INVENTION

Accordingly, it is a principal object of the present invention to provide an improved crate for the purpose of handling five-gallon bottles which is of unitary molded plastic construction to be rugged and durable for continuous and repeated service in supplying drinking water in such large bottles.

Further, an important object of this invention is to provide a water bottle crate conforming with the above object which has reinforced internal corner struts nested within each of the four corners of the crate limited to an area immediately adjacent the crate bottom to leave the box interior fully open throughout a major portion of its length.

Another object of the invention is to provide a molded plastic crate for five-gallon water bottles wherein the crate side walls are configured with an exterior midsection portion that is recessed such that the crate, while lying on its side, can accommodate pickup by a hand-truck.

It is also an object of the invention to provide a molded plastic crate having oppositely aligned sets of handle openings at different heights above the box bottom, these handle openings serving to catch the circumferential rib on a bottle exterior and restrain the bottle against inadvertent slippage from the crate.

Another object of the invention is the provision of a molded plastic crate provided with a separately mounted retaining bar disposed near the perimeter of the crate open end with this retaining bar projecting into the crate interior to act in restraining a bottle against unintentional slippage from the crate.

A further object of the invention is the provision of a five-gallon water bottle crate incorporating reinforced corner struts nested within each of the four corners of the crate and integrally joined with adjacent side walls and the crate bottom to furnish extreme strength and rigidity for the crate when carrying a filled bottle and/or when a plurality of such crates are in stacked condition during storage or transportion.

The molded plastic crate for transporting and storing differently configured five-gallon water bottles in accordance with the invention herein is formed by pairs of opposed side walls integrally joined at their adjoining longitudinal edges to define a square box with a centrally apertured bottom closing one end of this box. Reinforced internal corner struts are nested within each of the four corners of the box, integrally joined with adjacent side walls and the box bottom, with these struts terminating immediately above the bottom to leave a majority of the box interior completely open. Each of the box side walls has an exterior midsection portion that is recessed where the adjoining side wall edges meet, this recessing serving to accommodate hand-truck pickup when the crate is lying on its side. Each pair of opposed crate side walls is provided with a set of oppositely aligned wide handle openings with one set being located at a different height above the box bottom than the other set.

A separate retaining bar which is to project into the crate interior near the perimeter of the box open end so as to restrain a bottle against unintentional slippage from the crate may be provided and retained in place by a steel ring encircling the perimeter of the box open end. Preferably, this ring is received in an outwardly facing circumferential channel at the perimeter of the box open end with the ring serving both to strengthen the open end and to overlie the retaining bar to retain it in a slot through which it projects into the crate interior.

The features of the present invention which are believed to be novel are described hereinafter with reference to a preferred embodiment of the water bottle crate.

BRIEF DESCRIPTION OF THE DRAWINGS

The foregoing objects, as well as others, will become apparent through consideration of the following detail description of the invention given in connection with the accompanying illustrations on the drawings in which.

DETAILED DESCRIPTION OF A PREFERRED EMBODIMENT

Figure 1:
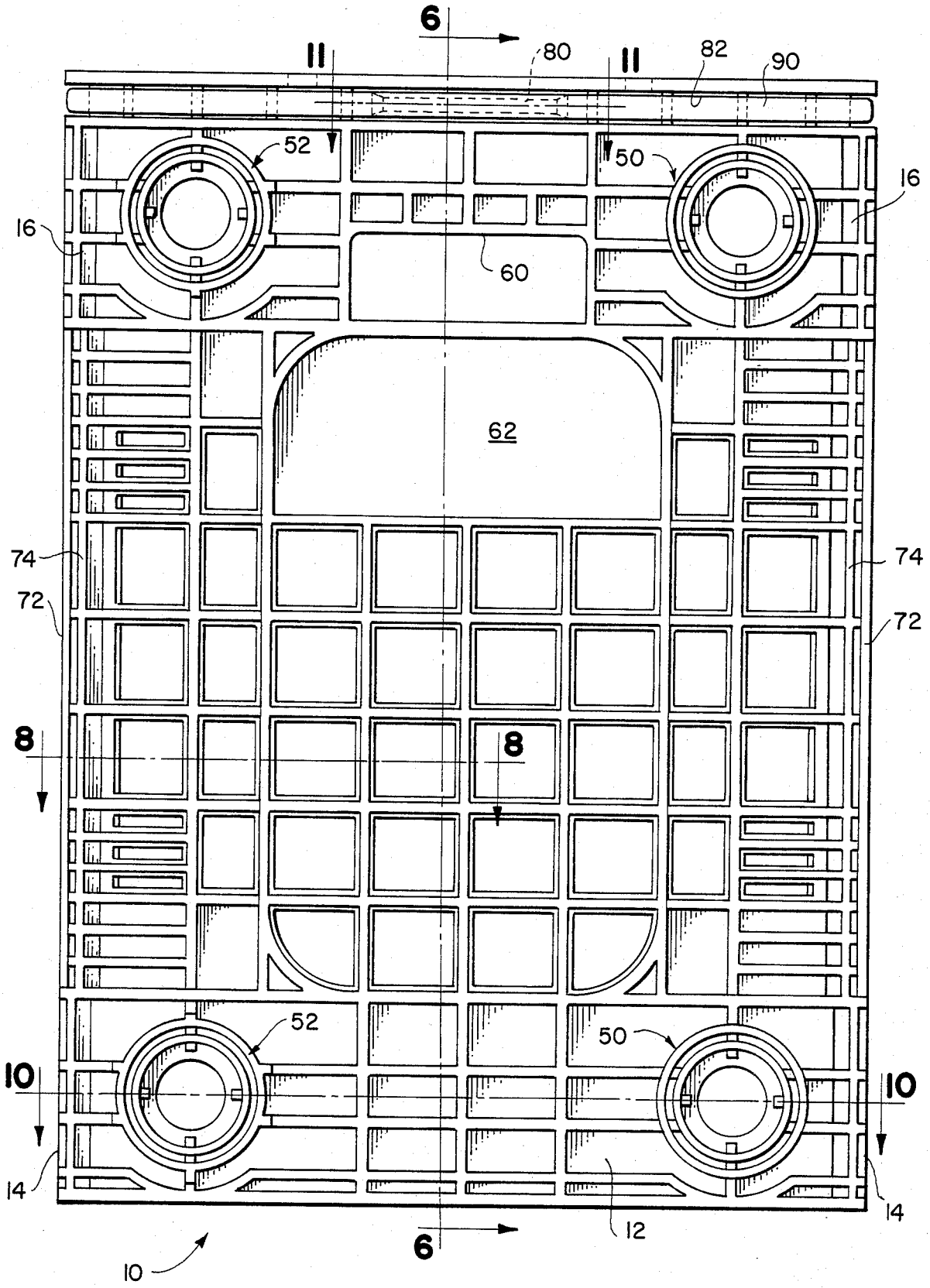
FIG. 1 is a side elevational view showing one of a first pair of opposed side walls forming the water bottle crate invention.
Figure 2:
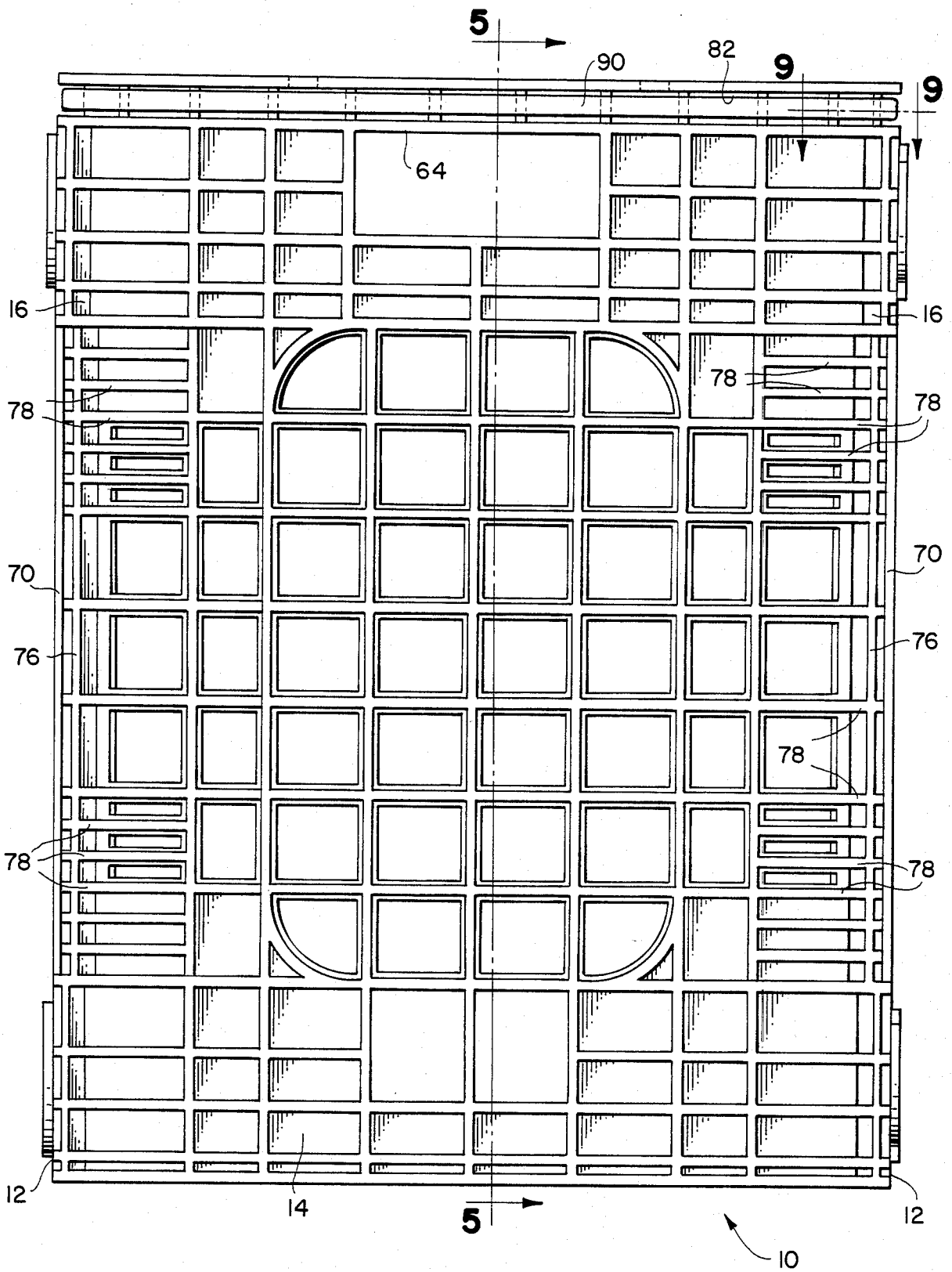
FIG. 2 is a side elevational view showing one of a second pair of opposed side walls forming the water bottle crate.

The overall construction for the five-gallon water bottle crate 10 may best be understood from FIGS. 1–4 on the drawings. FIG. 1 shows the external configuration of one of a first pair of opposed crate side walls while FIG. 2 shows the external appearance of one of a second pair of opposed crate side walls. These two pairs of opposed side walls are integrally joined in the plastic molding of the crate 10 by the adjoining longitudinal edges of the two pairs of opposed side walls being joined. These integrally united walls define a square box as viewed in the top plan view of FIG. 3 or as seen from the bottom on FIG. 4.

Figure 5:
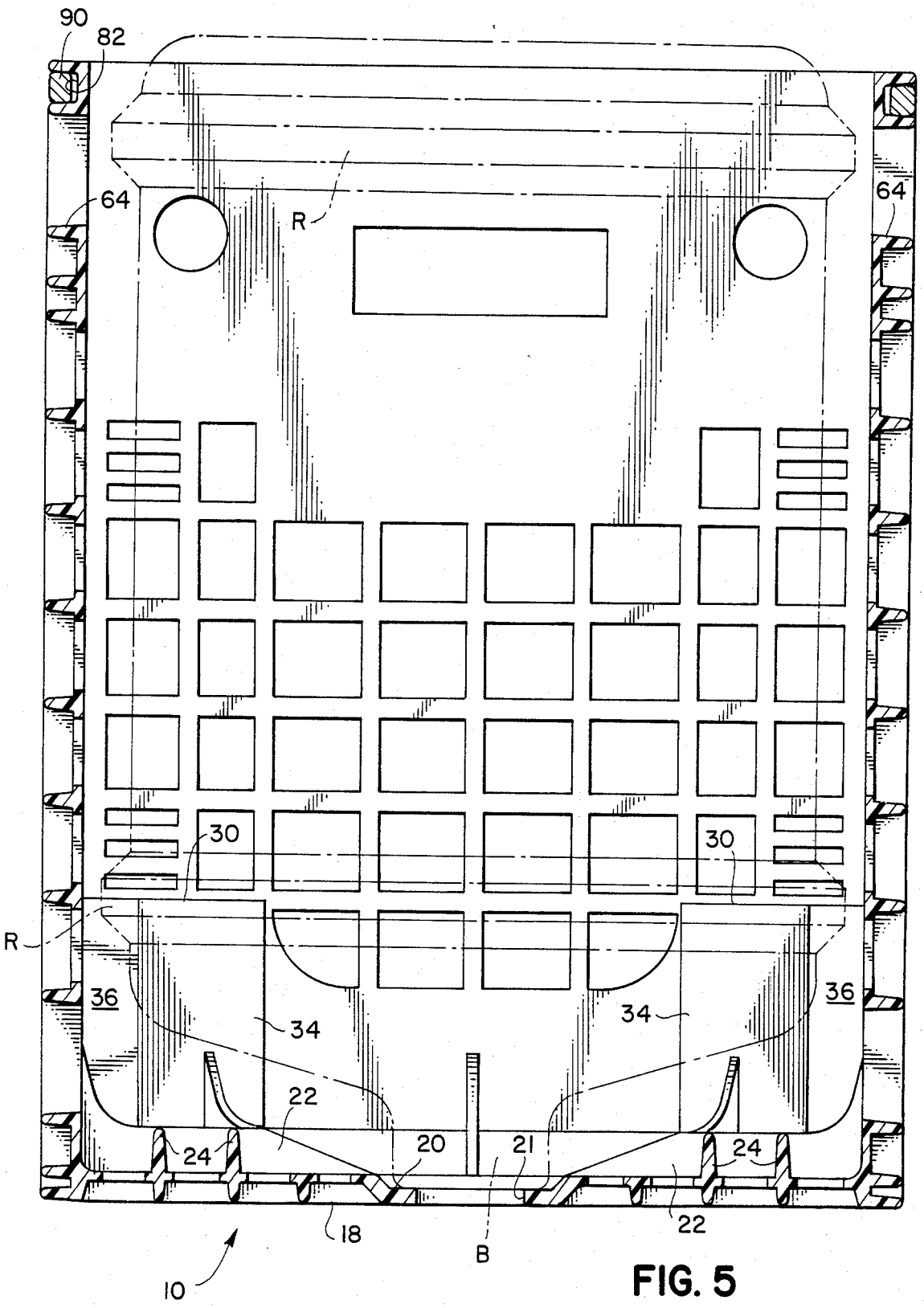
FIG. 5 is a sectional view taken on line 5—5 of FIG. 2 with an inverted water bottle shown in phantom lines within the crate for joint washing of the bottle and crate.

The sectional view of crate 10 on FIG. 5 shows the crate in its upright position with a five-gallon water bottle B, shown in phantom lines, positioned within crate 10 in an inverted condition such that the outermost end of the cylindrical neck of the bottle rests on an annular ledge surrounding a central aperture in the bottom of crate 10. In the relationship shown on FIG. 5 the crate 10 and bottle B may be simultaneously washed.

Figure 6:
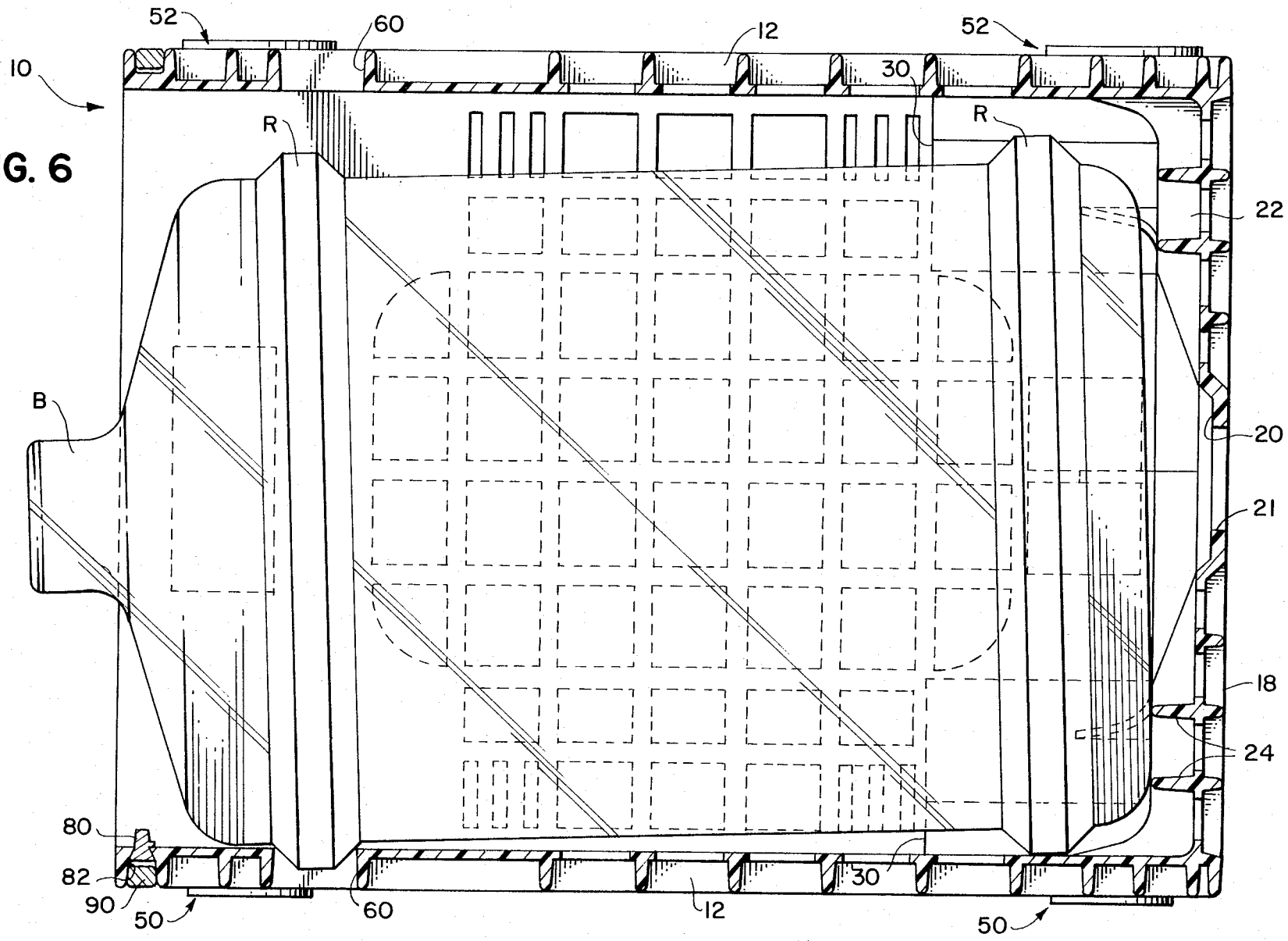
FIG. 6 is a sectional view taken on line 6—6 of FIG. 1 with the crate lying on its side and the circumferential rib on a bottle shown caught in a handle opening to restrain the bottle against slippage from the crate.

In the sectional view of FIG. 6 the crate 10 is illustrated lying on its side. Bottle B is shown disposed within the crate 10. It will be noted that the particular five-gallon water bottle B shown is configured to have a pair of spaced circumferential ribs R encircling the body of bottle B, one rib R being located near the bottom of the bottle B and the other rib R encircling the bottle body near the neck of bottle B. As shown on FIG. 6, with the crate 10 lying on its side, the rib R near the neck of bottle B has become caught in a handle opening provided in one of the side walls of crate 10 so as to restrain the bottle B against slippage from crate 10 when the crate is lying on its side as quite frequently occurs during transporting and storage of crates 10 containing filled or empty water bottles B.

Returning to consideration of the structural details of the water bottle crate 10 as shown in FIGS. 1–4, a first pair of similar opposed side walls 12 and a second pair of similar opposed side walls 14 have their adjoining longitudinal edges integrally joined incident the plastic molding of the crate so as to define the square box with four corners 16. One end of the square box defined by the integrally joined opposed pairs of side walls 12 and 14 is closed by a bottom 18 which is integrally joined with the perimeter of the box formed by the lower ends of opposed side walls 12 and 14.

Figure 3:
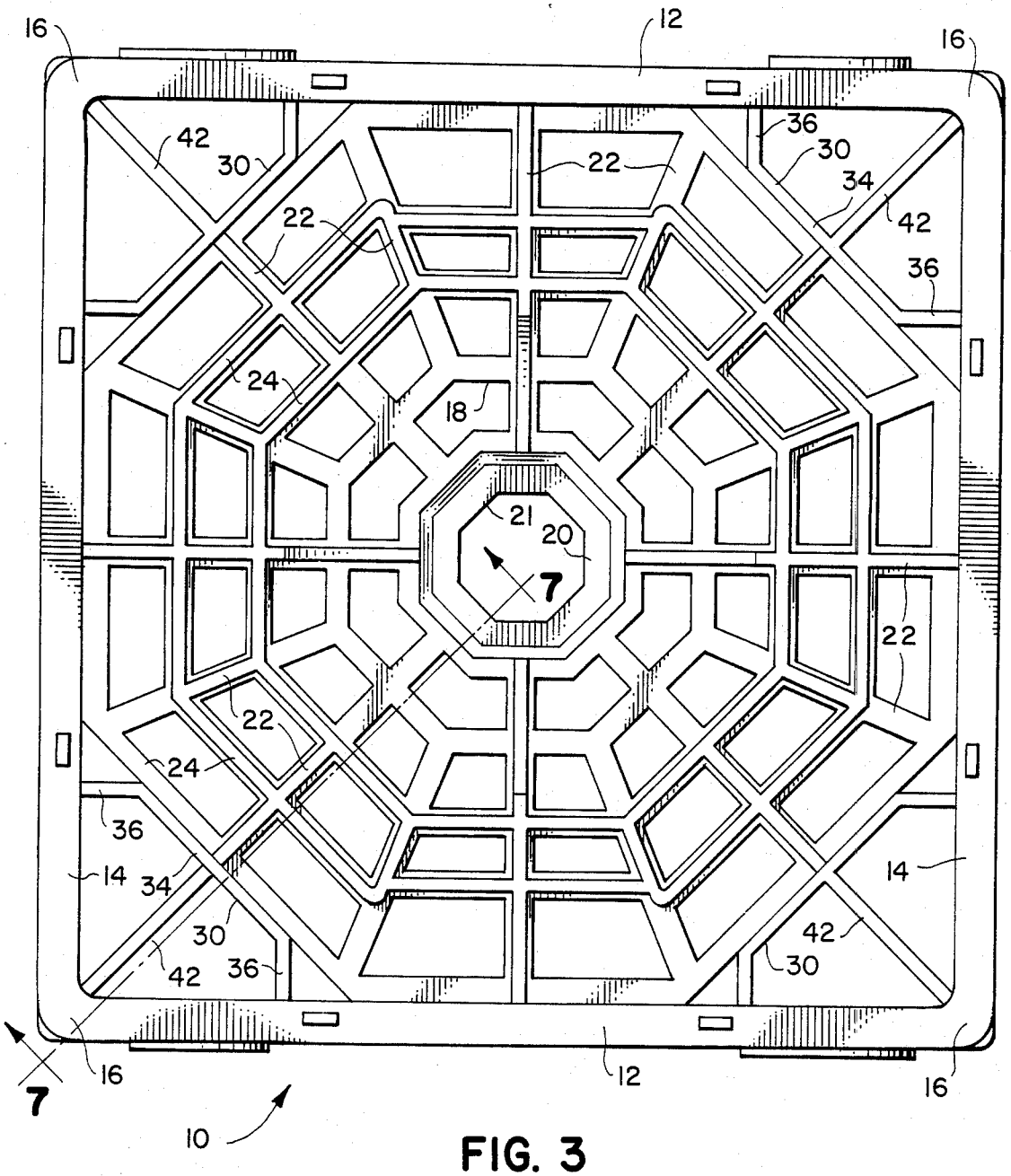
FIG. 3 is a top plan view looking down into the water bottle crate.
Figure 4:
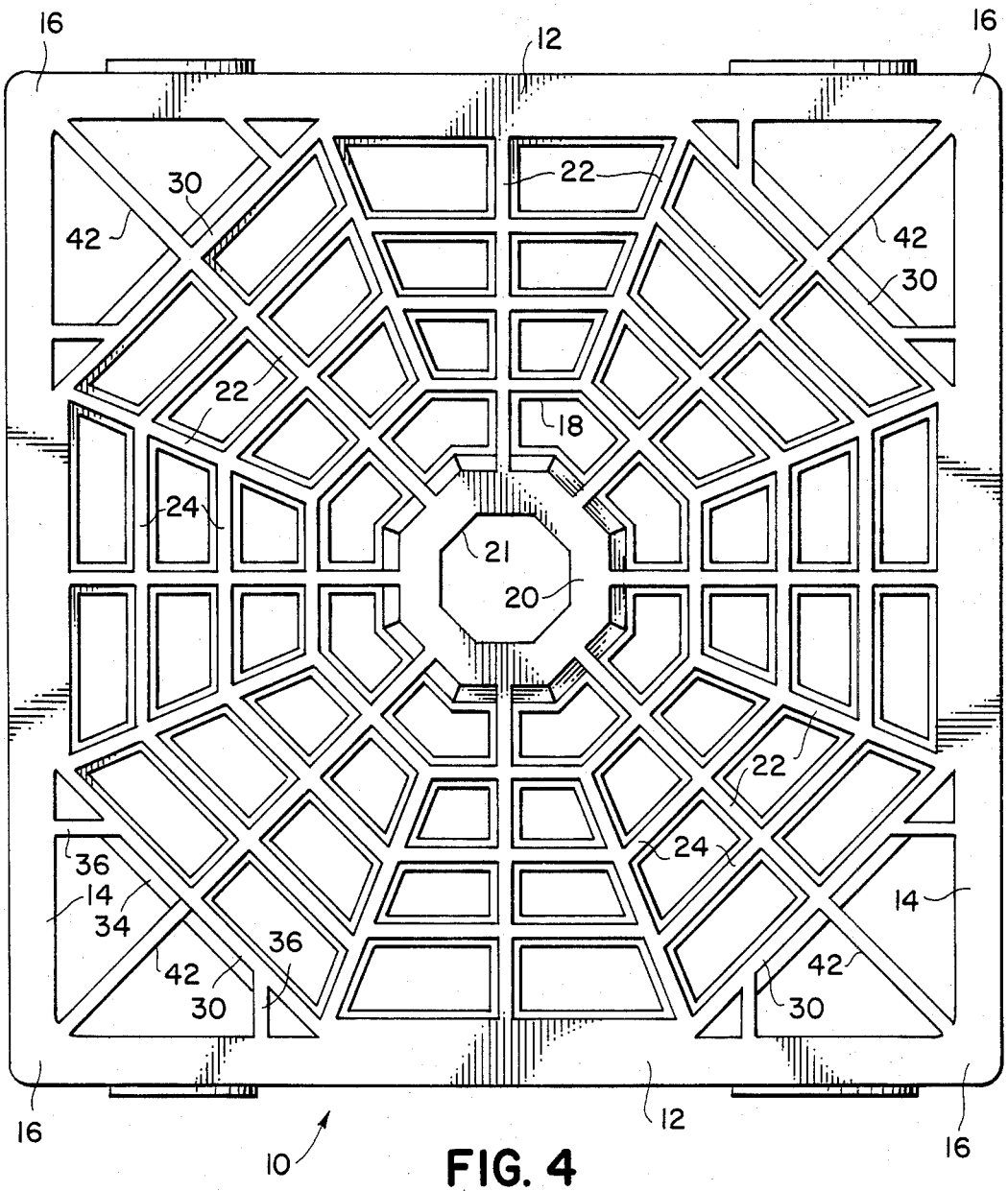
FIG. 4 is a bottom plan view of the water bottle crate.

As may be best seen from FIGS. 3 and 4, bottom 18 is formed by an open grid work having interconnected ribs which radiate outwardly from an annular ledge 20 which surrounds a central aperture 21 in bottom 18. Thus, ribs 22 radiate outwardly toward corners 16 and opposed side walls 12 and 14 while bridging ribs 24 strengthen ribs 22. The strength enhancing depth of the bridging ribs 24 which interconnect the radiating ribs 22 of bottom 18 may best be seen from FIGS. 5–7.

With reference to the above described open grid work form of bottom 18 with its annular ledge 20 encircling the central aperture 21, it will be noted how the ledge 20 surrounding central aperture 21 is aligned with the open bottle neck of the five-gallon water bottle B which has been inverted and inserted into crate 10 to carry out simultaneous cleaning of an empty bottle while housed upside down within the crate 10 as shown on FIG. 5.

Figure 7:
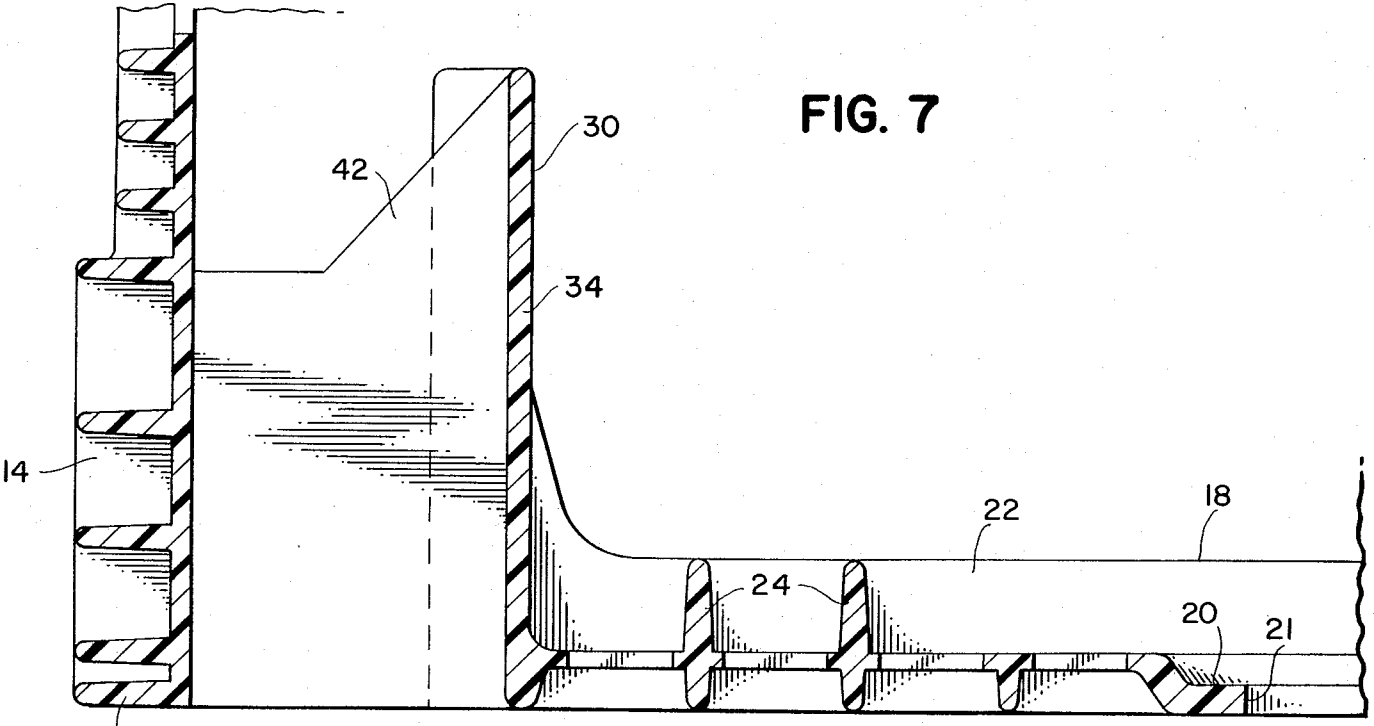
FIG. 7 is a fragmentary sectional view taken on line 7—7 of FIG. 3.
Figure 9:
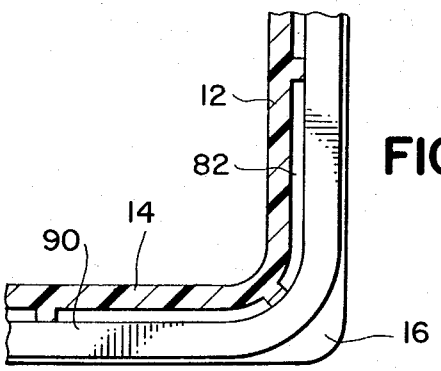
FIG. 9 is a segmental sectional view taken on line 9—9 of FIG. 2.

Internally at each of the corners 16 of the square box defined by the opposed side walls 12 and 14, and bottom 18, there is provided a reinforcing strut means, this being best seen on FIGS. 3, 4 and 7. The reinforcing internal corner strut means is nested within each of the four corners of the box and integrally joined with the adjacent side walls 12 and 14, and bottom 18. The strut means terminates immediately above the bottom 18 as may be appreciated from the sectional view on FIG. 7 and also seen by viewing FIGS. 5 and 6.

Each corner strut means nested within one of the four corners of the box includes an angulated wall 30. This angulated wall 30 extends generally diagonally across the box corner with which it is associated, bridging between adjacent side walls as shown on FIGS. 3 and 4. The angulated wall 30 has a central wall section 34 and two end wall sections 36 joined to the side edges of central wall section 34.

A strut wall 42 is integrally joined with the central wall section 34 of angulated wall 30. This strut wall 42 extends radially inwardly of the corner 16 to provide with the angulated wall 30 a reinforced corner strut means.

It will be observed from the top and bottom plan view of FIGS. 3 and 4 that the end wall section 36 of angulated wall 30 extend at approximately 45 degrees relative to the central wall section 34. Also each of the end wall sections 36 is disposed generally perpendicular to the particular side wall 12 or 14 with which the end wall section 36 is joined.

The reinforced internal corner struts which are nested within each of the four corners of the box defined by the two pairs of opposed side walls 12 and 14 terminate immediately above bottom 18 so as to leave the interior of the molded plastic crate 10 fully open throughout a major portion of its length. In this regard, the angulated wall 30 extends approximately a quarter of the height of the box interior above bottom 18.

As may be best seen on FIG. 7, the angulated wall 30 with strut wall 42 bridging to the crate corner 16 has wall 42 tapering dowardly from wall 30 to corner 16.

Figure 10:
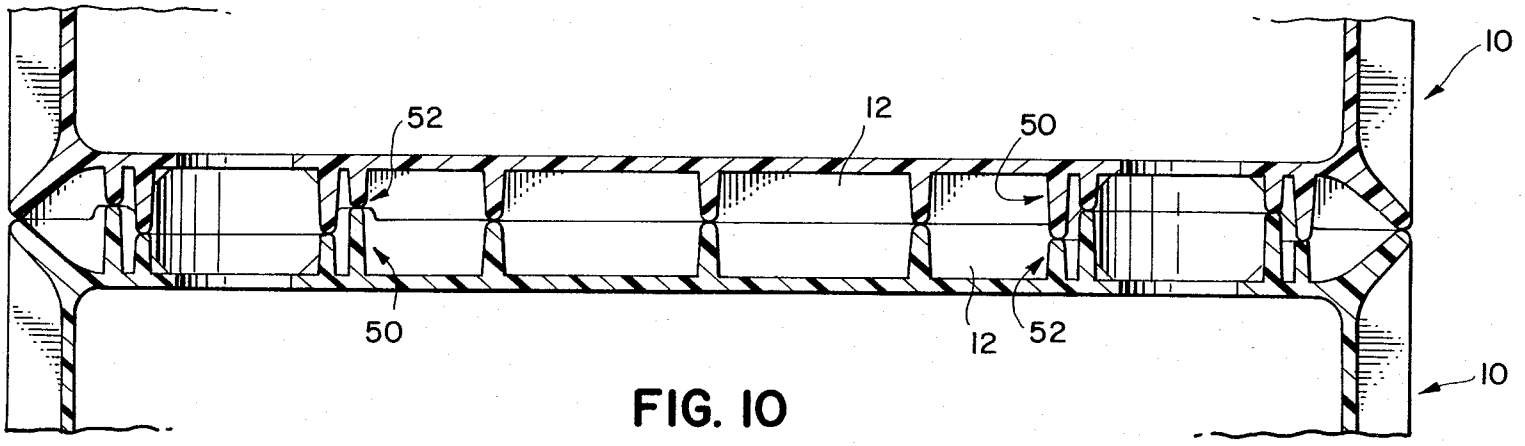
FIG. 10 is a sectional view generally taken along line 10—10 on FIG. 1, but showing a pair of water bottle crates having their mating side walls interlocked by way of concentric ring connectors.

Reference may now be made to the open grid work formation for each of the side walls 12 and 14 making up the two pairs of opposed side walls that, when integrally joined at their adjoining longitudinal edges, define the square box configuration of crate 10. Whereas each wall 12 making up the first pair of opposed side walls is similar in the configuration of its grid work and other features, there are differences between the outwardly projecting concentric ring connectors 50 and 52 exposed on the exterior of one wall 12 as compared with the other wall 12 making up this first pair of opposed walls. These concentric ring connectors 50 and 52 are employed to lockingly interengage adjacent crates 10 as may be necessary to securely maintain them in a stacked condition incident transportion and/or storage with empty or full five-gallon water bottles B. This locking interengagement between the concentric ring connectors 50 and 52 may best be understood by reference to the sectional showing on FIG. 10.

Concentric ring connector 50 has a relatively long outer ring enclosing a shorter inner ring. By the same token, concentric ring connector 52 has a short outer ring encircling a longer inner ring. The two rings of each connector 50 and 52 are of corresponding diameters such that, as shown on FIG. 10, the rings mattingly interengage as between the side walls 12 of two adjacent crates 10.

It will be appreciated from the side elevational view of FIG. 1 that with four concentric ring connectors, two connectors 50 and two connectors 52 at the four corners of wall 12 as shown, the companion wall 12 to make up the first pair of opposed side walls on the same crate 10 will have concentric ring connectors 50 formed along the left edge as viewed in FIG. 1 while the concentric ring connectors along the right edge will take the form of connectors 52. With this relationship, adjacent crates 10 may have their concentric ring connectors lockingly interengaged in the manner as shown on FIG. 10.

By further reference to FIG. 1, it will be seen that the first pair of opposed side walls 12 are each provided with a wide handle opening 60. As between the pair of side walls 12, these handle openings 60 are oppositely aligned in crate 10. This aligned relation between the handle openings 60 in walls 12 may also be seen from the sectional view of FIG. 6.

It will be seen that these oppositely aligned wide handle openings 60 in the first pair of opposed side walls 12 not only function as convenient handles for lifting the crate 10, but also when the crate is lying on its side as shown in FIG. 6, the circumferential rib R on a bottle B may be caught within the handle opening 60 thereby restraining the bottle B against inadvertent slippage from the crate 10.

Referring again to FIG. 1, each of the pair of side walls 12 may have a flat wall surface 62 molded therein to provide an appropriate surface area for applying desired indicia, such as, to identify the content of the bottle B, a trademark for the goods, the name of the bottle and/or crate owner, etc. Otherwise, the grid work of side wall 12 has an openness to virtually eliminate possible dirt traps with the grid work being formed with appropriate reinforcing ribs as may be seen by the sectional view of walls 12 on FIG. 6.

The grid work formation of the second pair of opposed side walls 14 may best be seen on FIG. 2. The openness of the grid work and configuration of the reinforcing ribs making up such grid work may also be seen in section on FIG. 5. This second pair of opposed side walls 14 are essentially identical in their molded configuration.

Each side wall 14 has a wide handle opening 64. When the pair of opposed side walls 14 are assembled with the first pair of opposed side walls 12 into the box forming the molded plastic crate 10, these wide handle openings 64 in side walls 14 are oppositely aligned with one another. However, it is to be noted that the aligned handle openings 64 in walls 14 are disposed at a height different from the height above the box bottom 18 than that at which the handle openings 60 in side walls 12 are located. On the other hand, both pairs of handle openings 60 and 64 may be located at the higher position shown for handle openings 64 or at the lower position shown for handle openings 60, the positioning of the handle openings depending on the characteristics of the bottle being handled.

By providing the two sets of handle openings 60 and 64, each set being at a different height relative to the bottom 18 of crate 10, handling of the crates 10 is facilitated since the different handle heights allows the option of using the particular handle set that provides the most finger clearance for the person lifting the crate. This variation in finger clearance can occur by reason of differing external configurations for commercially available five-gallon water bottles to be transported and stored within crates 10. With several styles of such bottles on the market, each having its own distinctive rib work such as the location of ribs R on bottle B illustrated on FIG. 6, the different heights for the sets of handle openings 60 and 64 relative to the crate bottom 18 provides crate 10 with a wide range of utility to enable accommodating five-gallon water bottles different external configurations.

With respect to both pairs of opposed side walls 12 and 14, each side wall has an exterior midsection portion that is recessed. Thus, when the adjoining edges of these side walls forming the upstanding corners of the box of crate 10 are molded, there is an area 70 along the opposite sides of each wall 12 which is recessed and also an area 72 along the opposite sides of each wall 14 that is recessed. These recessed exterior midsection portions on walls 12 and 14 serve to accommodate hand-truck pickup when the crate is lying on its side. In other words the pickup plate on the conventional hand-truck may be easily slid into the recessed portion 70 or 72 on the side of a crate when the crate 10 is lying on its side to pickup one or a stack of crates with empty or full bottles B without having to tilt the crate or stack of crates 10.

Figure 8:
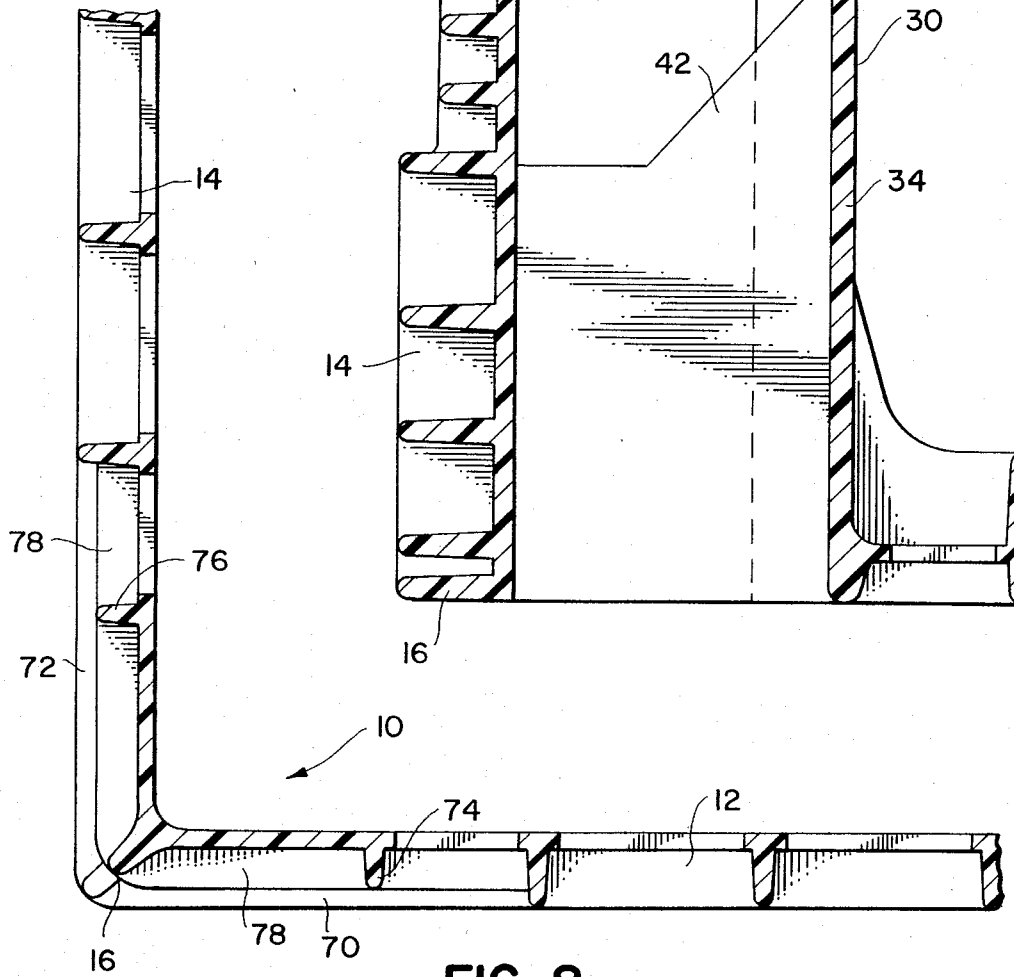
FIG. 8 is a partial sectional view taken on line 8—8 of FIG. 1.

The manner in which the recessed areas 70 and 72 is formed along the exterior midsection portion at the upstanding corners of the crate 10 may be easily seen from the sectional view on FIG. 8. As shown thereon the rib at the corner 16 of crate 10 is shortened along the exterior midsection portion. Similarly, upstanding rib 74 on wall 12 is shortened to define the recessed area 70. Likewise, upstanding rib 76 on crate side wall 14 is shortened to provide the recessed area 72. Additionally, all of the laterally extending reinforcing ribs 78 throughout this exterior midsection portion on both walls 12 and 14 at the upstanding corners of the crate 10 are shortened so that the entire recessed areas 70 and 72 are provided to accommodate the pickup flange of a hand-truck when the crate 10 is lying on its side.

For use in transporting and storing five-gallon water bottles configured with one or more circumferential ribs R as shown on the bottle B in FIG. 6, the crate 10 may be provided with a retaining means mounted near the perimeter of the open end of crate 10 with this retaining means projecting into the crate interior. This retaining means then acts to restrain a bottle B against unintentional slippage from the crate acting as backup against a bottle slipping out should the bottle rib R inadvertently become dislodged from one of the handle openings 60 or 64 (See FIG. 6).

Figure 12:
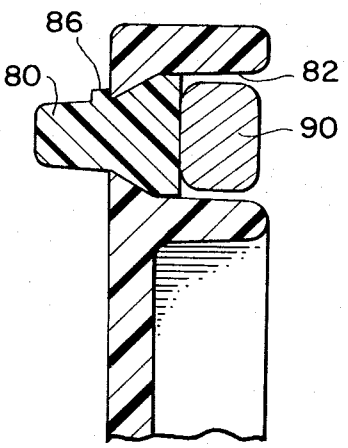
FIG. 12 is a sectional view taken on line 12—12 of FIG. 11.
Figure 11:
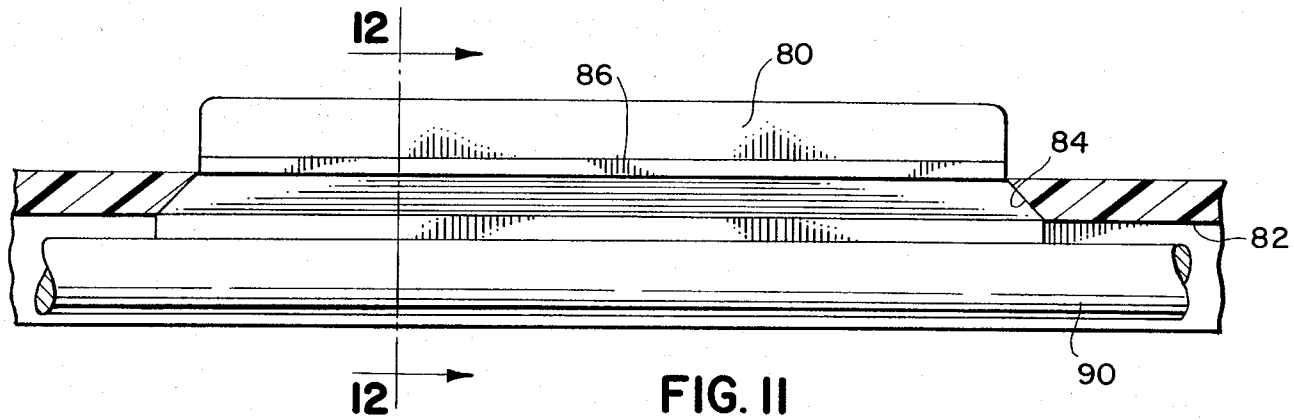
FIG. 11 is a segmental sectional view taken on line 11—11 of FIG. 1.

In the embodiment of the molded plastic crate 10 specifically illustrated on the drawings, this retaining means is shown in the form of a bar 80 as may be seen from FIGS. 11 and 12.

The perimeter of the open end of the square box defined by the two pairs of opposed side walls 12 and 14 is formed with an outwardly facing circumferential channel 82. A slot 84 is formed in at least one of the side walls 12 and 14 near the perimeter of the open end of crate 10. The bar 80 is inserted through this slot so that it projects into the crate interior to act in restraining a bottle B against unintentional slippage from the crate. This relation of bar 80 to the bottle B may be seen from FIG. 6, although on FIG. 6 the bottle B is shown with its circumferential rib R caught in the handle opening 60. It will be recognized that in using crate 10 with a retaining bar 80 the bottle B with its rib R is stopped from slipping out of crate 10 by the inward projection of bar 80 which acts as a backup restraining means to keep the bottle against unintentional slippage from the crate.

The provision of outwardly facing circumferential channel 82 with slot 84 formed therein provides crate 10 with an additional advantage when a reinforcing ring 90 is accommodated in channel 82. Ring 90, preferably of steel, encircles the perimeter of the open end of crate 10, serving as a strengthening means for this open end of the crate. Additionally, the ring 90 passes over bar 80 as shown in FIGS. 11 and 12 so that it functions to retain bar 80 within slot 84.

It will be understood that the bar 80 may be provided with a longitudinal rib 86 such that the bar may be passed through slot 84, snapping it into firm retaining engagement with the end of side wall 12 at the perimeter of crate 10.

Also, while the bar 80 is shown as made of plastic, it is also possible to have bar 80 made of steel in which case the bar 80 could be welded directly to the steel ring 90 with bar 80 still protruding through slot 84 as shown on FIGS. 11 and 12.

It is to be recognized that, depending upon the external configuration of the five-gallon water bottles to be used with the crates 10, the retaining bar 80 may be omitted. In this regard the advantages of using the steel reinforcing ring 90 received within channel 82 to strengthen the open perimeter end of crate 10 may be retained by utilizing the ring 90 without a retaining bar 80.

Whereas a preferred embodiment has been illustrated and described as illustrative of the invention herein, it is to be understood that the water bottle crate of the invention herein shown and described must be taken only as a preferred representation of the invention. Accordingly, various changes and modifications in the arrangement and configuration of the components, parts, elements, etc. and molding techniques used may be resorted to without departing from the disclosure of the invention or the scope of the appended claims.

We claim:

1. A molded plastic crate for transporting and storing differently configured five-gallon water bottles comprising:

two pairs of opposed side walls integrally joined at their adjoining longitudinal edges to define a square box;

a centrally apertured bottom closing one end of said box;

reinforcing internal corner strut means nested within each of the four corners of said box integrally joined with adjacent side walls and said bottom, said strut means terminating immediately above said bottom to leave the box interior fully open throughout a major portion of its length;

each of said side walls having an exterior midsection portion that is recessed where said adjoining edges form the upstanding corners of said box to accommodate hand-truck pickup when the crate is lying on it side; and one pair of said side walls having oppositely aligned wide handle openings provided at a first height above said box bottom and the other pair of said side walls having oppositely aligned wide handle openings provided at a second height above said box bottom that is different from said first height, said handle openings serving to catch the circumferential rib on a bottle exterior to restrain the bottle against slippage from the crate.

2. A crate as recited in claim 1 further comprising retaining means mounted near the perimeter of the open end of said box, said retaining means projecting into the crate interior to act in restraining a bottle against unintentional slippage from the crate.

3. A crate as recited in claim 2 wherein said retaining means is a bar mounted in a slot formed in at least one of said side walls near the perimeter of the box open end.

4. A crate as recited in claim 3 wherein said perimeter is formed with an outwardly facing circumferential channel and reinforcing ring is received in said channel, said ring strengthening said open end and overlying said bar to retain said bar within said slot.

5. A crate as recited in any one of claims 1, 2, 3 or 4 wherein each of said corner strut means includes an angulated wall extending generally diagonally across the box corner between adjacent side walls, and a strut wall integrally joined with said angulated wall, said strut wall extending radially outwardly to and integrally joined with the box corner to provide with said angulated wall a reinforced corner.

6. A crate as recited in claim 5 wherein said angulated wall terminates at its juncture with said bottom.

7. A crate as recited in claim 5 wherein said angulated wall has a pair of end wall sections joined to the side edges of a central wall section, said end wall sections extending at approximately 45 degrees relative to said central wall section with each end wall section being disposed generally perpendicular to the box side wall with which the end wall section is joined.

* * * * *